United States Patent [19]

Mitchell

[11] Patent Number: 4,658,615

[45] Date of Patent: Apr. 21, 1987

[54] ROLLER FLANGING MACHINE FOR METAL STRIPS AND THE LIKE

[75] Inventor: Randolph N. Mitchell, Rome, Italy

[73] Assignee: Slim-Societa Lavorazioni Industriali Metalli S.p.A., Cisterna Di Latina, Italy

[21] Appl. No.: 681,872

[22] Filed: Dec. 14, 1984

[51] Int. Cl.[4] ..... B21B 15/00; B21B 37/00

[52] U.S. Cl. ..... 72/16; 72/17; 72/199; 72/203; 72/224

[58] Field of Search ..... 72/199, 235, 205, 203, 72/204, 224, 16, 17

[56] References Cited

U.S. PATENT DOCUMENTS 231,146 8/1880 Briggs ..... 72/224

3,055,241 9/1962 Hedgecock et al. ..... 72/205

*Primary Examiner*—R. L. Spruill

*Assistant Examiner*—Steve Katz

*Attorney, Agent, or Firm*—Laff, Whitesel, Conte & Saret

[57] ABSTRACT

A roller flanging apparatus for flanging a metal strip has a flanging head that comprises a pair of working idler rollers. The idler rollers have outer surfaces forming a flanging angle therebetween. The edge of the metal strip passes between the rollers in contact with the roller outer surfaces to provide a flange on the metal strip edge. The idler rollers have an axis which defines an acute angle with a line extending perpendicular to a line that indicates the direction of movement of the metal strip and the acute angle is defined in the direction of movement of the metal strip.

4 Claims, 2 Drawing Figures

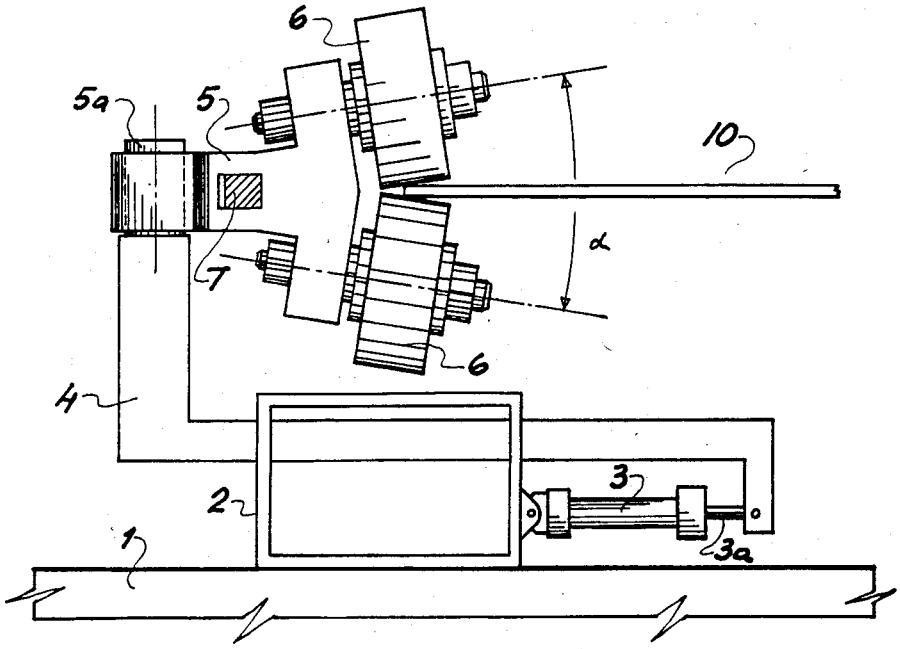
FIG. 1
FIG. 2
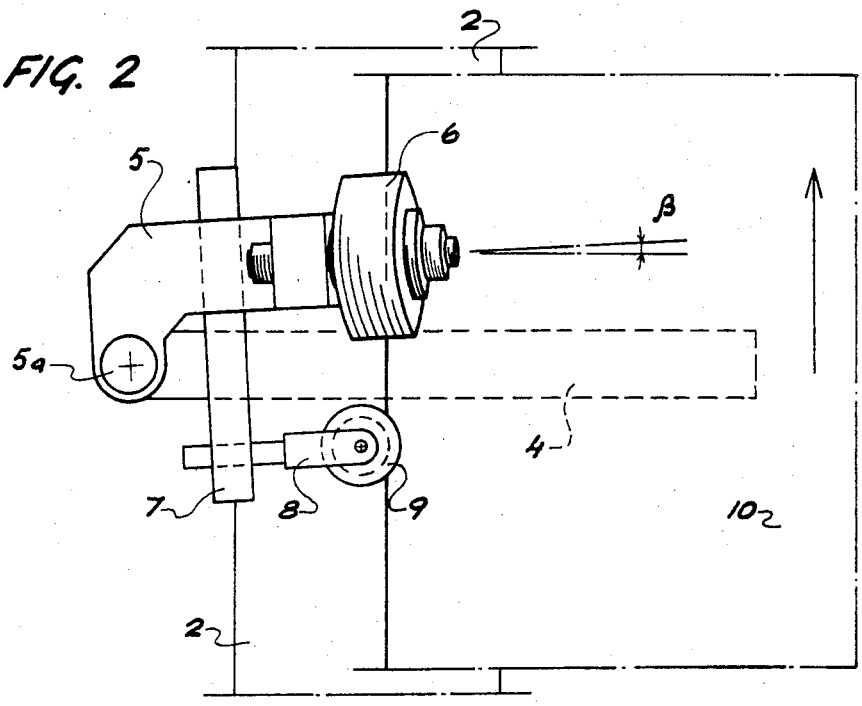

ROLLER FLANGING MACHINE FOR METAL STRIPS AND THE LIKE

The present invention relates to a roller flanging machine for metal strips and the like.

It is known that there are at present on the market flanging machines for metal strips comprising several sets of rollers disposed in cage-shaped structures aligned along the path of the strips. The edges of the strips positioned inside these machines are flanged during successive stages up to the obtention of a rounded profile.

Another known solution provides a machine equipped with rollers disposed transversely to the longitudinal axis of the strips to be flanged and embracing the same strips along the whole width thereof. The strips are constantly pressed on their edges up to the obtention of a deformation by flattening of the burrs. In this machine too it is possible to provide several roller postures which all together carry out a gradual flattening operation.

There are at last other machines that carry out the removal of the burrs and consequently the flanging by means of mechanical workings using chip removing tools. These machines utilize a grinding wheel, for example.

The known technical solutions listed above are unsatisfactory for different reasons. In fact, they appear of a complicate construction, very bulky and have a rather high manufacture cost. Furthermore, in use they continuously need to be adjusted.

More particularly, the technical solution in which the flanging is obtained by flattening, with the use of rollers extending over the whole width of the strip does not ensure a regular appearance of the same strip; on the contrary, it may cause local variations in thickness on the flanged strip.

The technical solution based on the use of a grinding wheel or the like appears of difficult adjustment and needs a periodic replacement of the grinding wheel. In addition, it has a low production rate as it presupposes a reduced forward motion of the strip.

Finally, the technical solution in which the flanging is obtained by rolling, that is making the edges pass through several postures of caged rollers, necessitates an expensive and bulky machine which is also difficult to adjust.

It is therefore a general object of the present invention to obviate the above mentioned drawbacks by providing a flanging machine which is of easy construction, not very bulky and has a particularly competitive cost, while being at the same time suitable to ensure the best reliability as to a long lifetime as well as a high quality level.

It is a further important object of the invention to provide a flanging machine which is of easy adjustment and which can ensure a constant and satisfactory production quality even if the strips are not well stretched and have a weak guiding.

These and still further objects which will become more apparent in the following are achieved by a flanging machine comprising a fixed structure movably supporting a flanging head, characterized in that said flanging head comprises a set of working idler rollers disposed symmetrically on opposite sides with respect to the lying plane of said strip and the axes of which diverge from each other and lie in a plane perpendicular to said strip and angled with respect to the direction of extension of the same.

Furthermore, a rotatable contrast wheel is suitably provided which rotates about an axis perpendicular to said strip and disposed integral to said working rollers by means of a number of variable arm levers; said contrast wheel resting on an edge portion of said strip immediately adjacent the portion tightened by said working rollers.

Further features and advantages will become more apparent from the description of a preferred but not exclusive embodiment of a flanging machine given hereinafter by way of example only with reference to the accompanying drawings, in which:

FIG. 1 is a partially exploded face view of the flanging machine according to the invention, in an operative position on the edge of a strip;

FIG. 2 is a plan view of the members of the machine according to the invention which are disposed in direct contact with a strip to be flanged.

Referring to the drawings, the flanging machine in accordance with the invention comprises, among other parts, a fixed anchoring structure 1 on which a fixed frame 2 is positioned, said frame being the bedplate of the machine. The positioning of the fixed frame 2 on structure 1 depends upon the width of the strip to be flanged, said strip being indicated at 10.

The end of a preferably air operated cylinder 3 provided with a rod 3*a* is integral to said fixed frame 2. Said rod engages with a slidable frame 4 movably crossing the fixed frame 2 and bearing up the flanging head of the machine according to the invention.

Said flanging head is substantially defined by an oscillating arm 5 bearing some rollers 6 which are the working rollers of the machine. The latter are cylindrical idler rollers mounted on bearings.

The working rollers 6 are positioned on the arm 5 so as to form, with the respective axes thereof, an angle of variable width $\alpha$ depending upon the kind of flanging required and defining with the strip 10 two half-angles which do not need to be alike.

The oscillating arm 5 is integral to a guide device for the flanging head comprising a set of levers and particularly a lever 7 transverse to the axes of the working rollers 6 suitable to be axially positioned and supporting one end of a rod 8 at right angles thereto and also adapted to be axially positioned. The rod 8 bears a splined contrast wheel 9 the axis of rotation of which is at right angles to the plane of the strip 10.

In FIG. 2 it is possible to see that the rod 8 can be positioned with respect to lever 7 so that the oscillating arm 5 can dispose the working rollers 6 with their axes of rotation lying in a plane perpendicular to the strip 10 but inclined with respect to the same by an angle of incidence $\beta$ obtained by rotating the oscillating arm 5 about its respective articulated joint 5*a* in a direction consistent with the forward motion of strip 10.

After giving a description of the flanging machine according to the invention from a prevalently structural point of view, we are going now to describe the operation thereof.

The strip 10, stretched and suitably guided, passes through the flanging machine limitedly to its longitudinal edge. It is therefore necessary to provide for a flanging machine on each side of the same strip 10. Passing therethrough the strip 10 undergoes, on its longitudinal edge, the action of the working rollers 6 pressed on the strip itself by means of the air operated cylinder 3. The force exerted by the pneumatic cylinder 3 is directed, through the movable frame 4, transversely to the extension direction of the strip 10 and in the plane of extension of the latter. At the same time, by virtue of the angle of width $\alpha$, the working rollers 6 carry out a rolling of the strip edge and a tapering of the thickness of the same. The working rollers 6 are furthermore applied to the strip 10 with an angle of incidence $\beta$ between the plane including the axes of rollers 6 and the plane perpendicular to the extension direction of the strip 10. This angle of incidence can be varied depending upon the type of material from which the strip is made and upon the state of the strip edge before the flanging: by increasing the angle of incidence $\beta$ it is possible to obtain an increase of the force applied onto the strip.

The kinematic connection between the working rollers 6 and the contrast wheel 9 allows to make the working rollers 6, which tend to be entrained in the feeding direction, more steady so as to rotate about the articulated joint 5*a*.

Practically it has been found that the machine according to the invention can efficiently act on strips of very different conditions, always achieving an excellent and uniform flanging and a high production rate.

The invention thus envisaged is susceptible of several modifications and variations without departing from the spirit and scope of the same. Thus, for example, if the strip 10 is well stretched and guided it is possible to eliminate the contrast wheel 9 together with the respective rod 8 and lever 7. In this case the flanging head has to be composed of a non oscillating arm 5 which must rather be integral to the sliding frame 4.

All the details may be replaced by technically equivalent elements. Practically the materials used, the shapes and sizes can be whatever according to the requirements.

I claim:

1. A roller edging apparatus for a metal strip comprising a movable support member which supports an edging head, said edging head supporting a pair of working idler rollers, said idler rollers having outer surfaces forming an edging angle therebetween and said edging angle being adapted to have an edge of said metal strip pass between said rollers in contact with a portion of said roller outer surfaces to provide an edging on said metal strip edge, said idler rollers being mounted on the edging head with their axes of rotation lying in a first plane substantially perpendicular with a second plane containing a line that indicates the direction of movement of said metal strip said first plane and a line transverse to said direction of movement defining an acute angle in the direction of movement of said metal strip, moving means attached to the support member to reciprocally move the edging head, and metal strip width response means attached to the moving means and being adapted to sense a variance in the width of said metal strip width and to activate the moving means to move the edging head.

2. The apparatus of claim 1 wherein said metal strip width response means is a rotatable contrast wheel, said contrast wheel mounted to rotate about an axis perpendicular to said metal strip, said contrast wheel being connected to said moving means by lever means and said contrast wheel adapted to rest on said metal strip edge adjacent to said idler rollers.

3. The apparatus of claim 2 wherein said contrast wheel has a groove adapted to directly engage the edge of said metal strip.

4. The apparatus of claim 1 wherein the moving means is an air cylinder.

* * * * *